US005671727A

United States Patent [19]

Squires et al.

[11] Patent Number: 5,671,727

[45] Date of Patent: Sep. 30, 1997

[54] CONFIGURABLE LOW PROFILE GAS FIREPLACE BURNER

[75] Inventors: David G. Squires, Barrie; John D. Salt, Orillia; Andrew C. G. Wilkes, Midhurst, all of Canada

[73] Assignee: Hunter Energy Technologies Inc., Midhurst, Canada

[21] Appl. No.: 416,629

[22] Filed: Apr. 5, 1995

[30] Foreign Application Priority Data

Dec. 23, 1994 [CA] Canada ..... 2139096

[51] Int. Cl.[6] ..... F24C 3/00

[52] U.S. Cl. ..... 126/512; 126/92 R; 431/125

[58] Field of Search ..... 126/512, 92 R, 126/92 AC, 91 R, 92 A; 431/328, 354, 125, 326

[56] References Cited

U.S. PATENT DOCUMENTS

| | | | |
|---|---|---|---|
| 503,705 | 8/1893 | Miller . | |
| 659,553 | 10/1900 | Sharpe . | |
| 764,279 | 7/1904 | Dudgeon . | |
| 1,260,442 | 3/1918 | Pickup . | |
| 2,470,881 | 5/1949 | Zimbelman | 158/116 |
| 2,711,215 | 6/1955 | Squire et al. | 158/116 |
| 3,247,838 | 4/1966 | Frick | 126/41 |
| 4,418,456 | 12/1983 | Riehl | 431/354 |
| 4,726,351 | 2/1988 | Whittaker et al. | 126/512 |
| 4,869,664 | 9/1989 | Wright et al. | 431/125 |
| 4,930,490 | 6/1990 | Allan | 126/92 R |
| 4,940,407 | 7/1990 | Rehberg et al. | 126/512 |
| 4,986,254 | 1/1991 | Haen et al. | 126/41 R |
| 5,328,356 | 7/1994 | Hawkinson | 431/125 |

*Primary Examiner*—James C. Yeung

*Attorney, Agent, or Firm*—Fitzpatrick, Cella, Harper & Scinto

[57] ABSTRACT

A gas fireplace has a set of artificial logs. The logs rest on top of a burner. The burner is formed from top and bottom metal sheets. The sheets are sealed together around a channel matched generally to the prospective position of the logs. A gas orifice feeds gas into the channel, while gas ports in the top sheet release the gas. The gas ports are positioned to match the final position of the logs. The channel is formed by creating a depression in the bottom sheet using a press with a general purpose stamping die moving in the pattern of the channel, or a single hit special purpose die, or a rolling die moving in the pattern of the channel, or by the bottom sheet being moved across a stationary rolling or beading die in the pattern of the channel. Secondary air holes feed air through the burner adjacent to the channel and the gas ports. The burner has a low profile, is manufacturable using conventional sheet metal techniques, and the ports, channel and holes may be redesigned for different fireplace characteristics. The logs may be replaced by or used in combination with other decorative fire material such as artificial coal or simulated embers. One or more recesses may be formed in the top sheet into the channel for recessing at least those gas ports that would be visible through the log set and for receiving alternate decorative fire material for hiding the ports.

10 Claims, 8 Drawing Sheets

CONFIGURABLE LOW PROFILE GAS FIREPLACE BURNER

FIELD OF THE INVENTION

The invention relates to burners for use in gas fireplaces.

BACKGROUND OF THE INVENTION

There are many factors in designing gas fireplaces. Four of the most important are cost, minimizing the overall size of the fireplace, maximizing the viewing area and providing an attractive flame or glow. Each of these factors are affected by the size, design and placement of the gas burner used in the fireplace.

This description is made with reference to gas fireplaces. This includes gas fireplaces, i.e. those that simulate natural log fires, whether or not the fireplaces are certified as a decorative gas appliance, room heater, wall furnace or otherwise.

Burners for gas fireplaces come in many shapes. Some are simply straight tubes of an inch or so in diameter with holes drilled, punched, lanced, cut or otherwise formed at spaced intervals in a line along the length of the tube. Gas is fed in one end of the tube and escapes from the holes to be ignited. Typically a separate burner tray is used to hold a set of artificial logs and the burners are placed in front of the logs above the tray. This type of arrangement is shown in U.S. Pat. No. 5,267,552 to Squires et at.

The logs must be designed to assist in hiding the burners from view. This limits their minimum height.

The placement of the logs is also restricted to positions that hide the burners from view. The logs must also be placed in positions that produce a pleasing flame or glow. The glow is produced by heating of the artificial log to red hot, while an attractive flame is produced by impinging it on the logs to create a yellow or orange flame, rather than the blue flame produced by a clean burning gas.

Other factors also affect the flame or glow, including the air flow patterns within the firebox. The air flow can direct the flame into and away from the logs. The air flow is dependent on the overall design of the fireplace and will change from one model to the next.

Not only does the burner design create restrictions for the log design, but those restrictions may not be known until prototypes are made or until a production unit is tested. If design changes are necessary then one or more of the burners, logs and overall fireplace design may have to be revised. Most gas fireplaces are manufactured primarily from sheet metal. Sheet metal workers sometimes contract out the supply of burners as they do not have the capability to manufacture the specialty tubular components. Changes to the burner design are undesirable, resulting in significant delays and additional expense.

Other burners include those typically seen in gas barbecues. These suffer from similar drawbacks to those described for tubular burners.

It is known to make a combined burner-burner tray from cast iron with a sheet metal top. The combination has a bottom tray with a depth providing an internal plenum between the tray and the top. Gas is fed into the plenum through the tray and emerges from holes in the top where the gas is ignited. The log set is placed on the top surface.

The top has the advantage of allowing holes to be placed almost anywhere in the top surface if the logs are to be moved, or if the original design does not produce the proper appearance. However, the overall burner is relatively thick and decreases the amount of available space for the viewing window, particularly in retrofit fireplace inserts. It is quite heavy. It requires a mould for the casting, which can be expensive to redesign for different size models.

The plenum design does not allow for full range of log placement due to limitations on providing secondary combustion air to the central area of the burner for complete combustion and pleasing flame pattern.

It is an object of the invention to address these or other problems with existing gas burners and fireplaces.

SUMMARY OF THE INVENTION

In a first aspect the invention provides a gas burner for use in a gas fireplace with decorative fire material. The gas burner has a top sheet for supporting the decorative fire material. A bottom sheet is sealed to the top sheet about a channel between the top and bottom sheet. There are a plurality of gas ports through the top sheet into the channel. There is at least one gas inlet orifice for receiving gas into the channel.

In a second aspect the invention provides a gas burner according to the first aspect with a log set serving as the decorative fire material. The path of the channel may be matched to the desired position of the log set, while the pattern of the gas ports may be matched to the desired position of the log set. Alternatively, the path of the channel may be matched generally to the prospective position of the log set, while the pattern of the gas ports is matched to the final position of the log set.

Secondary air inlets may be formed through the top and bottom sheets adjacent the channel. The channel may have a depression formed by continuously stamping the bottom sheet using a general purpose press with a general purpose forming die while the bottom sheet is moved in the pattern of the channel. Alternatively, the depression may be formed by stamping the bottom sheet using a single purpose stamping die and a single hit, or formed in the bottom sheet using a press with a swivel roller forming tool and moving the bottom sheet in the pattern of the channel.

The top sheet may be flat.

Alternatively, the top sheet may have one or more recesses formed into the channel. The recesses are for recessing at least those gas ports that would be visible through the log set. They are also for receiving alternate decorative fire material for hiding the ports.

In a third aspect the invention provides a gas fireplace that incorporates the burner of the second aspect.

BRIER DESCRIPTION OF THE DRAWINGS

For a better understanding of the present invention and to show more clearly how it may be carried into effect, reference will now be made, by way of example, to the accompanying drawing which show the preferred embodiment of the present invention and in which:

FIG. 1 is a cross-section of a conventionally vented gas fireplace and burner according to the preferred embodiment of the invention, the cross-section cuts through the burner along the lines I—I of FIG. 2, FIG. 2 is an exploded view of the burner of FIG. 1, FIG. 3 is a perspective view of the fireplace of FIG. 1 employing the burner of FIG. 2, FIG. 4(*a*) and (*b*) are a bottom view and a side view, respectively, of a die used to form a depression in the burner of FIG. 2, FIG. 5 is an exploded view of an alternate embodiment of the burner of FIG. 1, FIG. 6 is a perspective view of the fireplace of FIG. 1 employing the burner of FIG. 5, and FIG. 7 is a cross-section of a direct vent gas fireplace and burner according to an alternate embodiment of the invention, the cross-section cuts through the burner along the lines VIII—VIII of FIG. 5.

FIG. 8 is a detailed cross-section of an alternate embodiment of the area around a gas port in the burner of FIGS. 1, 5, or 7.

DETAILED DESCRIPTION OF THE PREFERRED EMBODIMENTS

Figure 1:
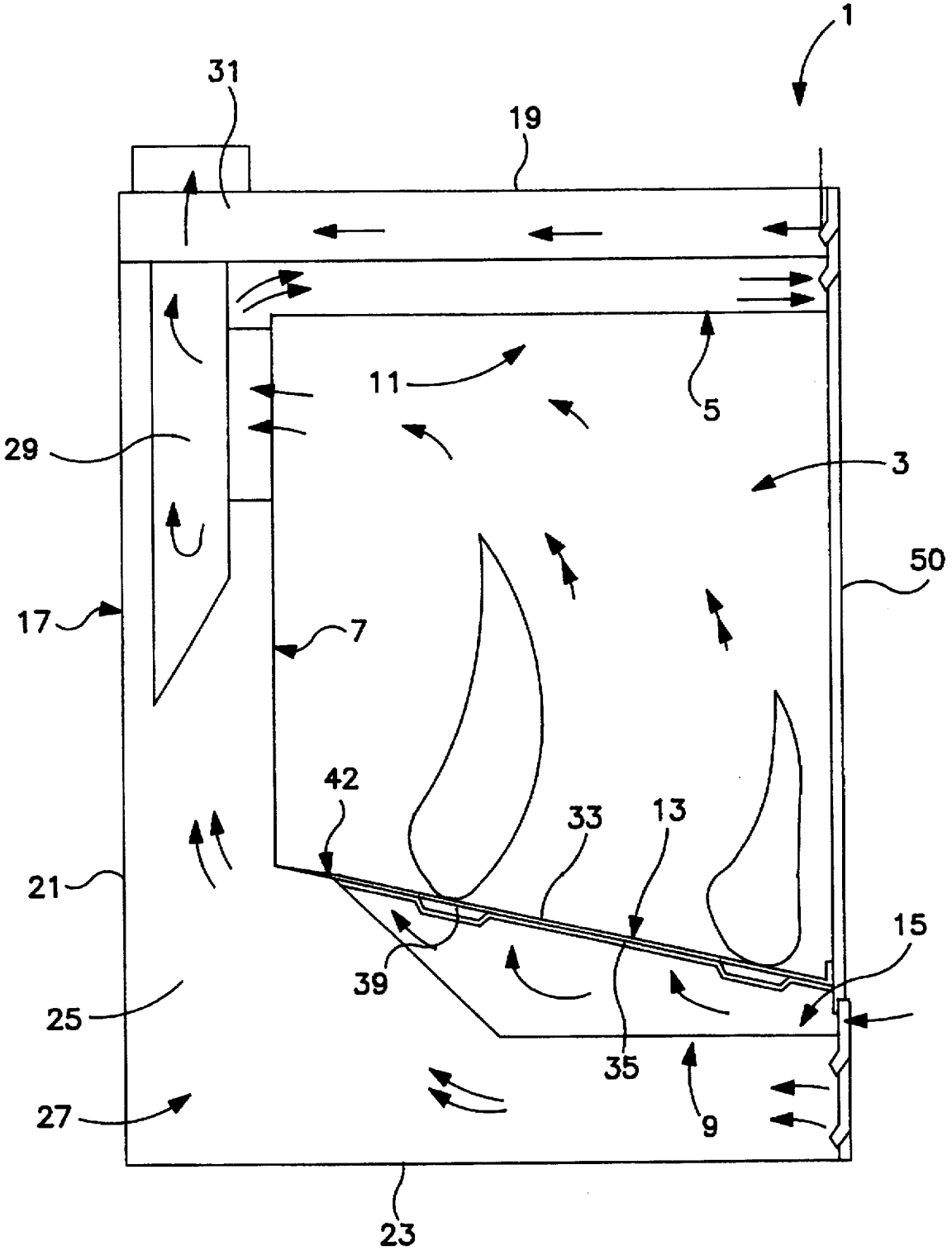
Figure 2:
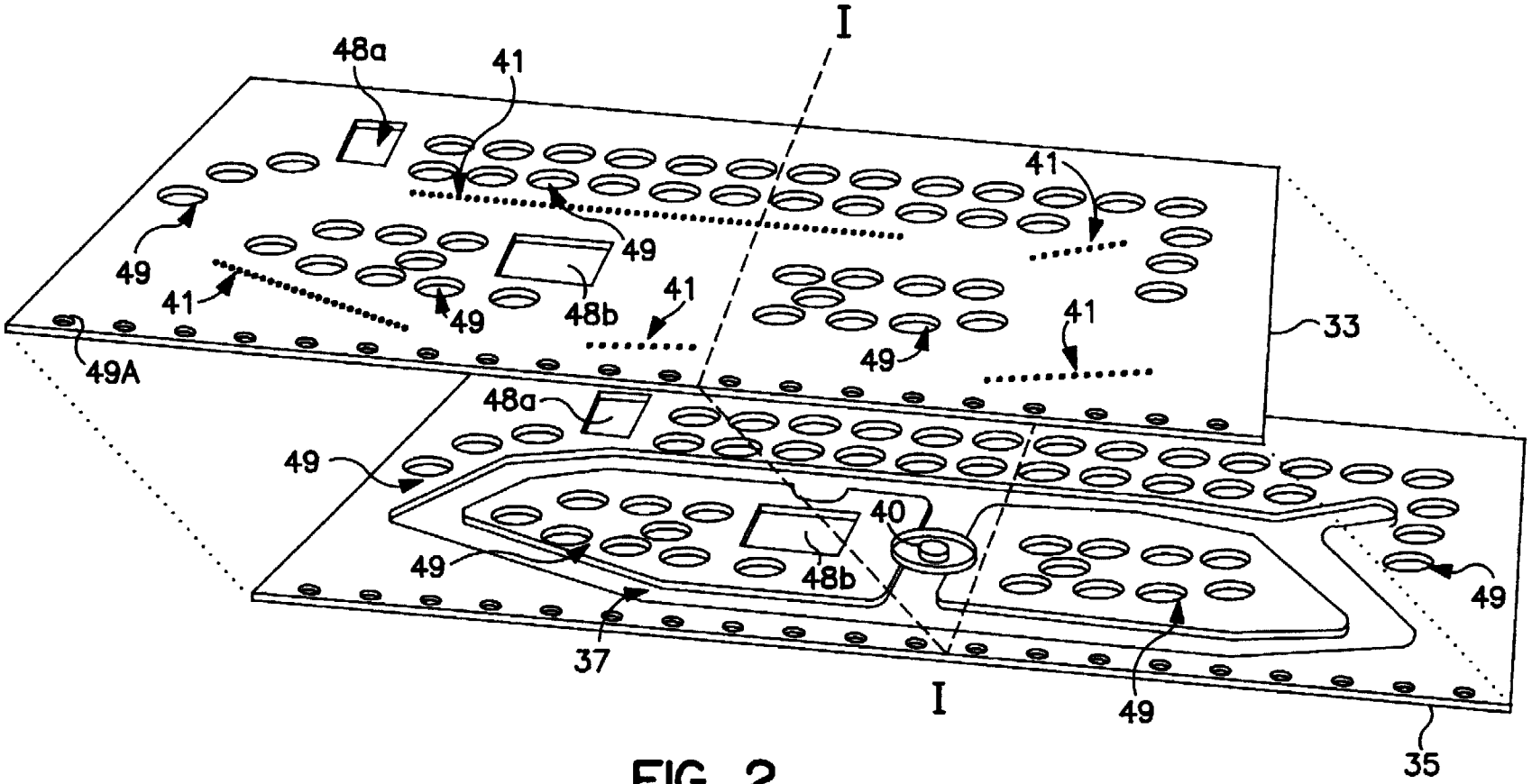
Figure 3:
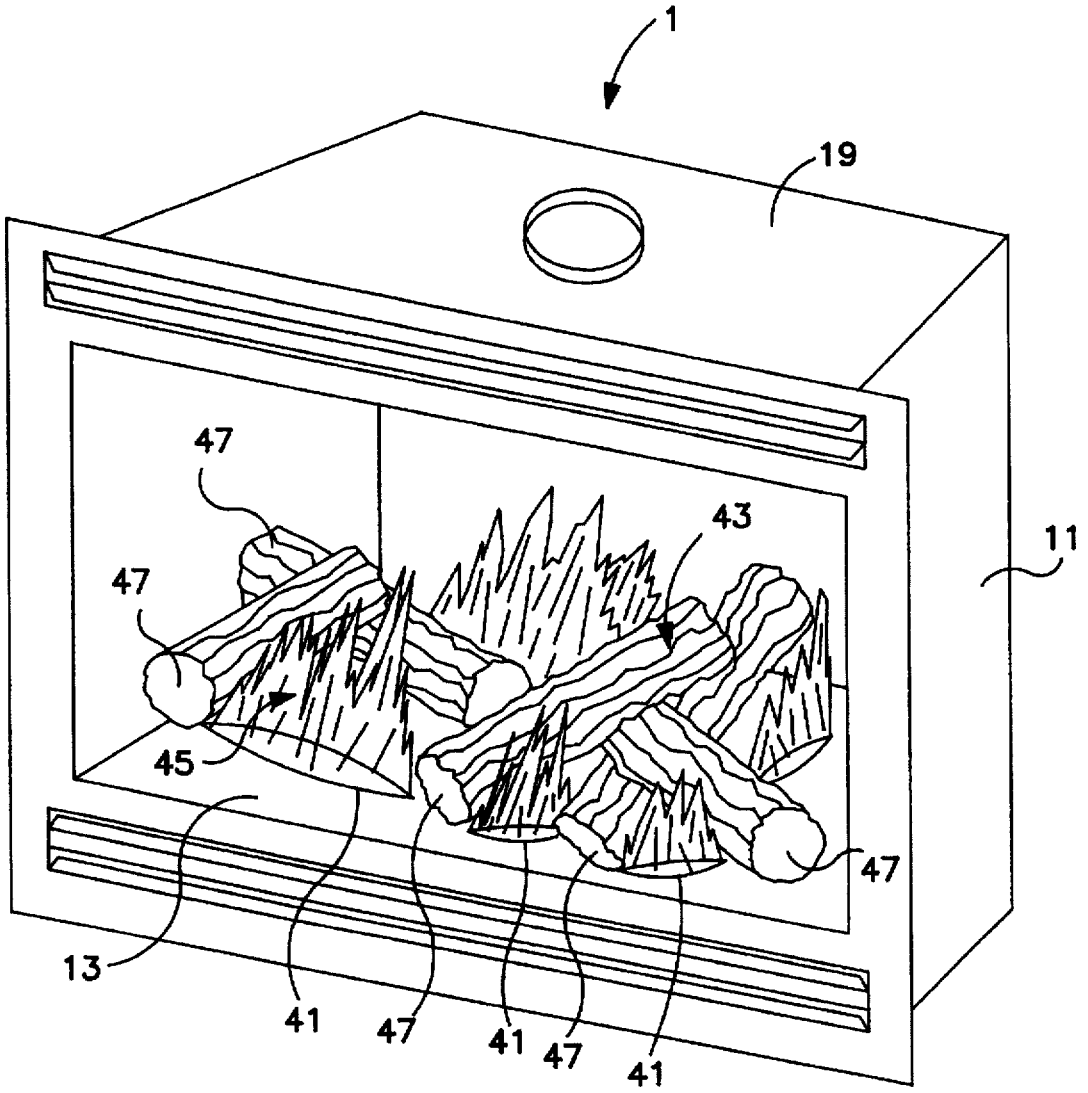

Referring to FIGS. 1 through 3, a gas fireplace 1 has a firebox 3 with top panel 5, rear panel 7, bottom panel 9 and opposing side panels 11. Above the bottom panel 9 is a burner 13 that defines a combustion air plenum 15.

The firebox 3 sits within an enclosure 17 having top surface 19, rear surface 21, bottom surface 23, and opposing side surfaces 25. The enclosure 17 is spaced away from the firebox 3 and defines a passage 27.

The rear panel 7 opens into an optional heat exchanger 29 that further opens into an exhaust duct 31.

The burner 13 has a top sheet 33 adjacent a bottom sheet 35. The sheets 33, 35 are formed from a suitable material such as cold rolled steel, zinc-iron coated steel, aluminized steel, stainless steal or other like material selected for adequate strength, corrosion resistance and heat resistance properties. The sheets 33, 35 are connected by a suitable fastening means such as rivets, welding, or a form tool in a punch press, not shown. The sheets 33, 35 need to be substantially sealed to one another to inhibit gas from leaking out between them. As shown in FIG. 2, the bottom sheet 35 has a depression 37 following a figure-eight pattern. As best seen in FIG. 1, in combination with the top sheet 33, the depression 37 forms a channel 39 for gas. Gas enters at a conventionally shaped primary air-gas orifice 40. Exiting through the top sheet 33 from the channel 39 is a plurality of gas ports 41 for releasing gas into the firebox 3 above the burner 13. The burner 13 is attached to the firebox 3 using screws 42 or other fastening means. Preferably the fastening means are releasable for enhanced serviceability.

As shown in FIG. 3, a log set 43 rests on the top sheet 33. The gas ports 41 are arranged so that flames 45 from ignited gas exiting from the channel 39 impinges on logs 47 in the log set 43 in an appealing manner. Some time 45 is needed to heat the logs 47 so that they become red hot and simulate glowing embers of a natural wood fire, while other flame 45 burns yellow or orange to simulate the type of flame that would occur in a natural wood fire.

Referring to FIG. 2, there is a log locator opening 48*a* through the burner 13 that corresponds to a plug, not shown, on the log set 43 to indicate the desired position for the log set 43. A pilot assembly opening 48*b* provides space for a pilot assembly, not shown, to ignite gas.

About the channel 39 through the sheets 33, 35 are holes, or secondary air inlets, groups of which are generally indicated by arrows 49 that bring secondary combustion air right to the ports 41. This increases the efficiency of the fireplace by burning an increased percentage of gas than would otherwise occur. A line of holes along the front of the burner 13, generally indicated at 49A, also serves to provide an air wash to a viewing window 50 of the firebox 3. It will be evident to one skilled in the art that the holes 49 could be any shape providing an adequate flow of secondary air, for example slots or squares.

Figure 4A:
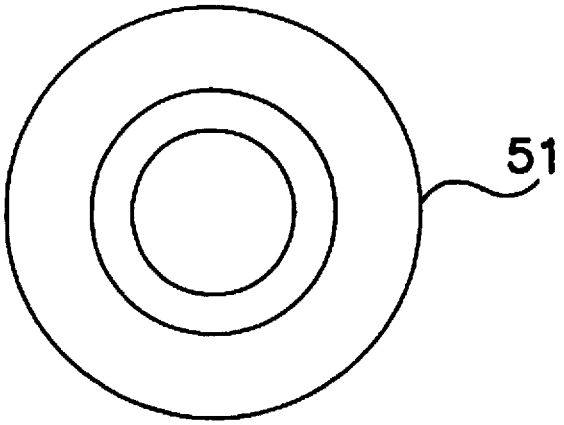
Figure 4B:
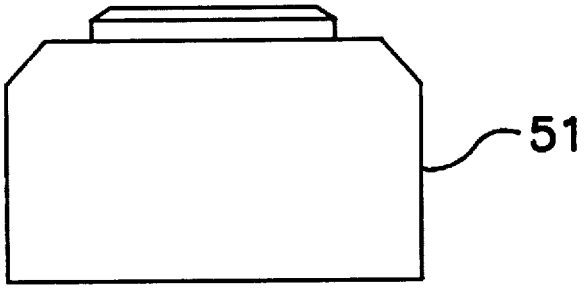

Referring to FIGS. 4(*a*) and (*b*), the depression 37 may be formed with a punch press, such as a CNC Turret Punch Press (e.g., Amada Aries 245™) not shown, using a forming punch or die 51 repeatedly brought into contact with the bottom sheet 35 as the bottom sheet 35 is moved in a programmed pattern. Alternatively, a conventional press could be used with a special purpose stamping die forming the depression 37 in a single hit, or a hydraulic CNC press with a swivel roller forming or beading tool.

The ports 41 are simply drilled, punched, lanced, cut or otherwise formed through the top sheet 33 into the channel 39. The burner 13 provides a wide range of flexibility in combining the number, spacing, configuration and sizes of holes. The burner 13 could produce virtually any BTU desired with the appropriate combination.

In operation, gas enters the burner 13 at the orifice 40. The movement of the gas draws primary combustion air into the orifice 40 from a room through the plenum 15 in a known manner. The gas flows through the channel 39 out the ports 41 where it is ignited by the pilot assembly to generate flames 45. Exhaust gases flow in a known manner by convection, or possibly power venting, out the optional heat exchanger 29 to the exhaust duct 31. Convection air is drawn from the room beneath the firebox 3 where it is heated in the passage 27 and exits back into the room above the firebox 3 to assist in transferring heat into the room and in cooling the firebox 3.

In FIG. 1, combustion air is indicated by single single-headed arrows (for example, A), convection air by pairs of single-headed arrows (for example, B), and exhaust gases by single double-headed arrows (for example, C). The same convention is used in the other Figures.

Figure 5:
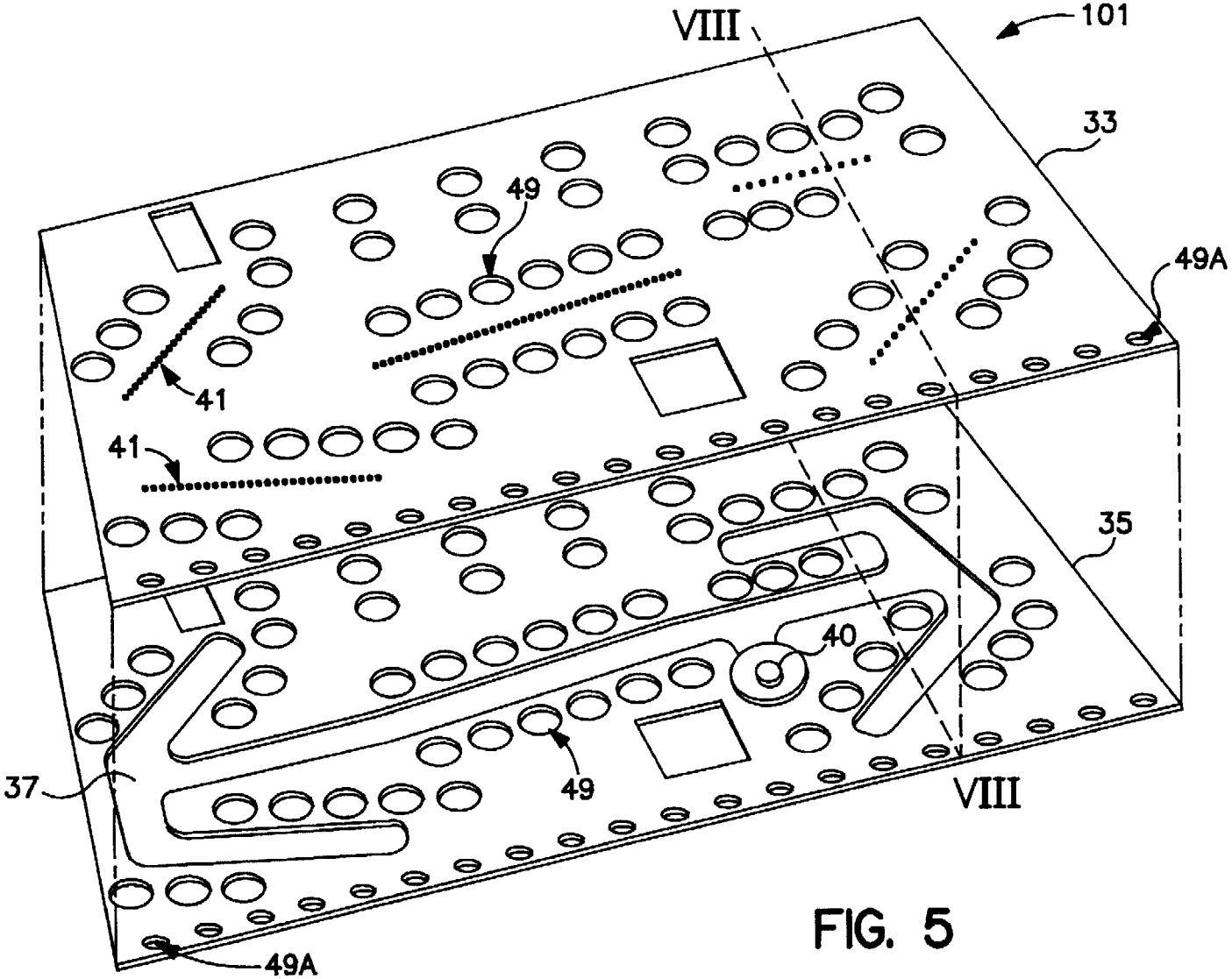
Figure 6:
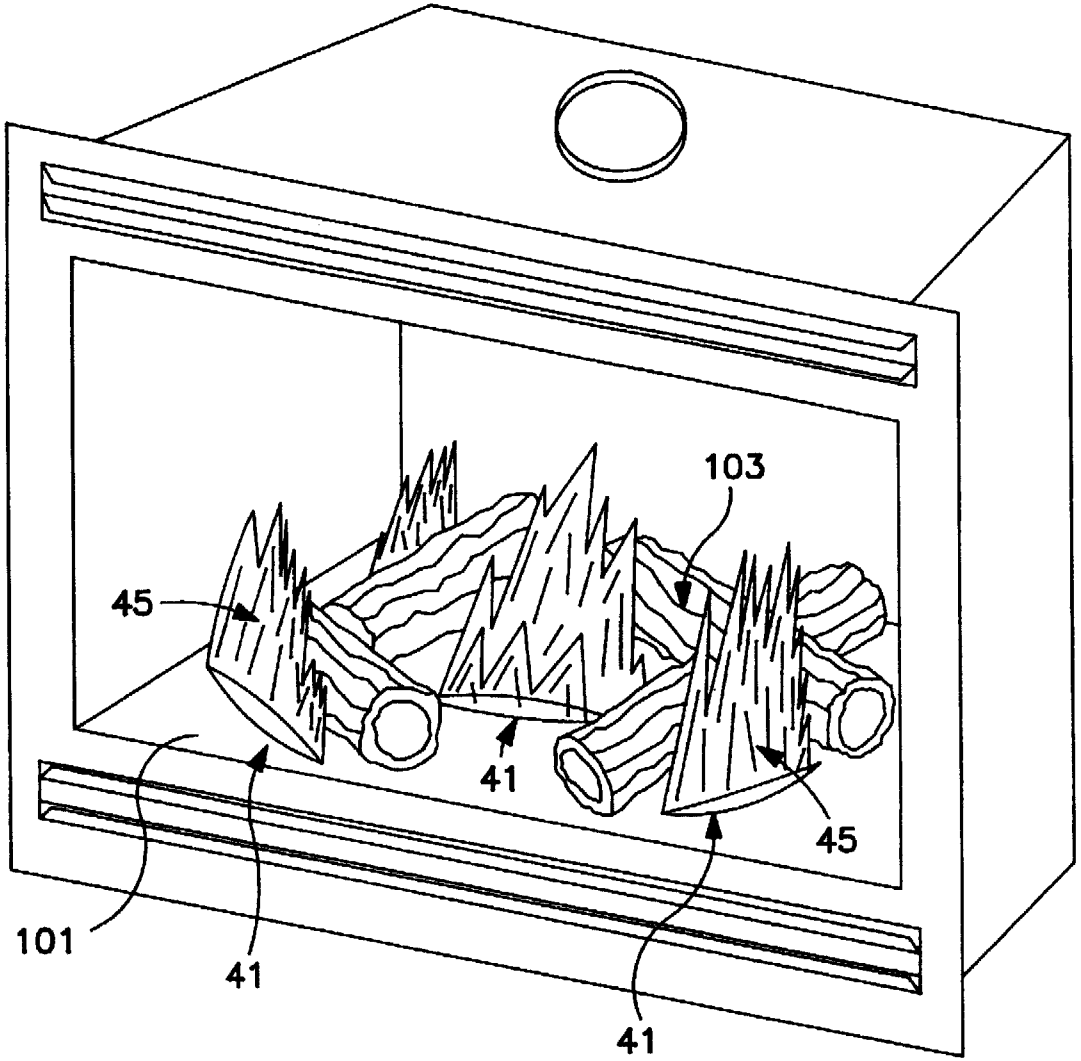

As shown in FIGS. 5 and 6, burner 101 can be made for an alternate log set 103. Like components have been given like reference numerals as used in FIGS. 1 through 3 and their description is not repeated here. The important principle illustrated by burner 101 is that the pattern of the depression 37 may be easily modified to suit other log sets. The pattern of the depression 37 may also be modified to suit other changed conditions, such as air flows and firebox size or shape, or simply modified to produce different aesthetic characteristics to suit varying tastes.

For minor changes to the position of the flames 45, the ports 41 can simply be moved within the channel 39 by drilling, punching, lancing, cutting or otherwise forming them in a different position.

Figure 7:
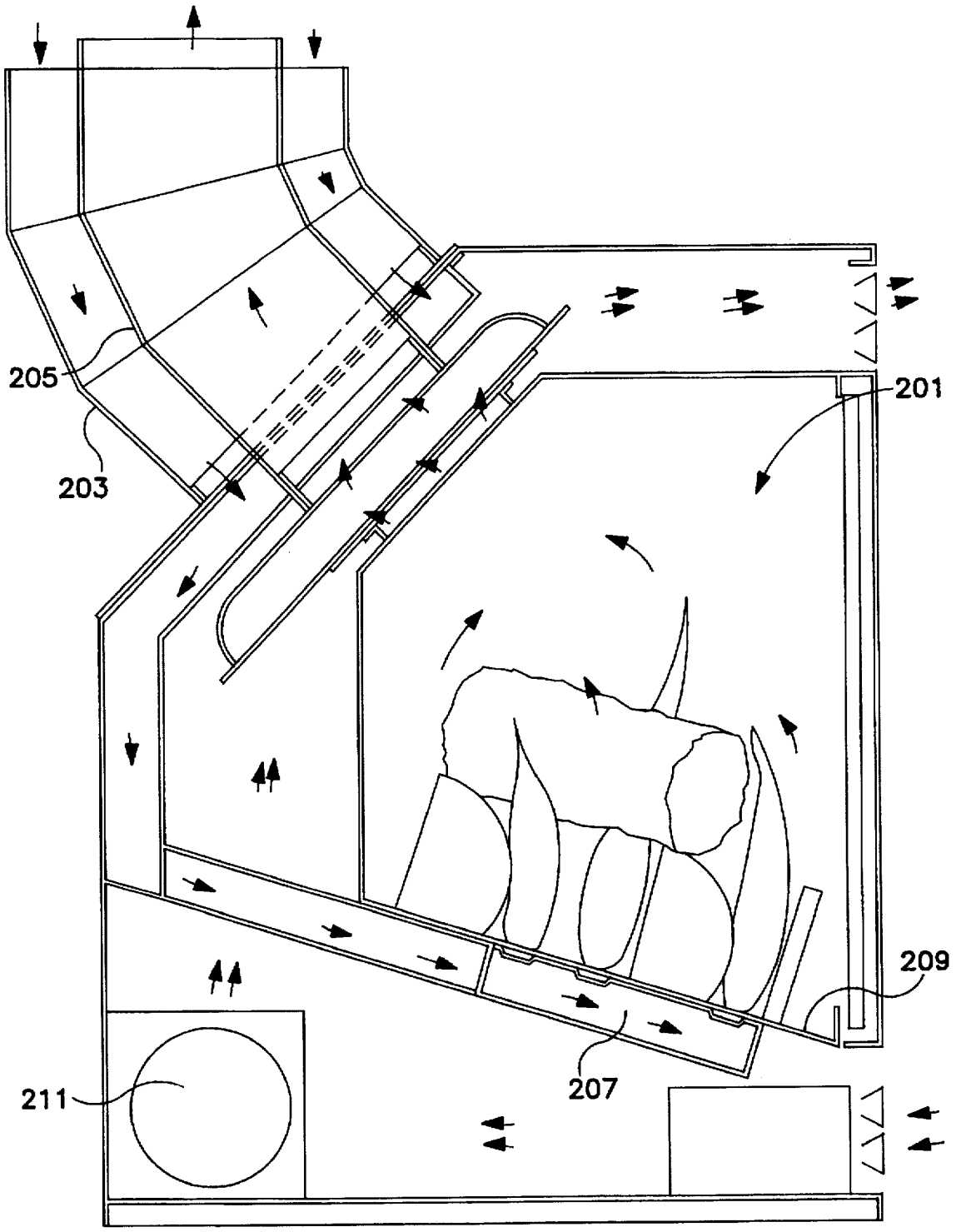

Referring to FIG. 7, the principles can be further extended to burners for other types of gas fireplaces such as direct vent types where a firebox 201 is sealed from the room air and combustion air is drawn in through a first duct 203 that is concentric with a second duct 205 for exhaust gases to exit the firebox 201. The combustion air enters at a plenum 207 beneath a burner 209. The burner 209 is otherwise similar to the burners 13, 101 and similar reference numerals have been used once again. An optional fan 211 may be used to assist in circulating convection air around the firebox 201. A similar fan, not shown, could also have been added to the fireplace 1 of FIG. 1.

Each of the burners 13, 101, 209 has a very low profile so as not to restrict the flexibility of fireplace design. They can be simply manufactured using existing sheet metal techniques. Modification in port pattern, both major and minor can be made relatively easily and inexpensively. The port pattern can be easily matched to particular log sets.

Other decorative fire material can be used in place of or in combination with the log sets 43, 103, while retaining the principles described herein. Such materials might include artificial coal or simulated embers.

Figure 8:
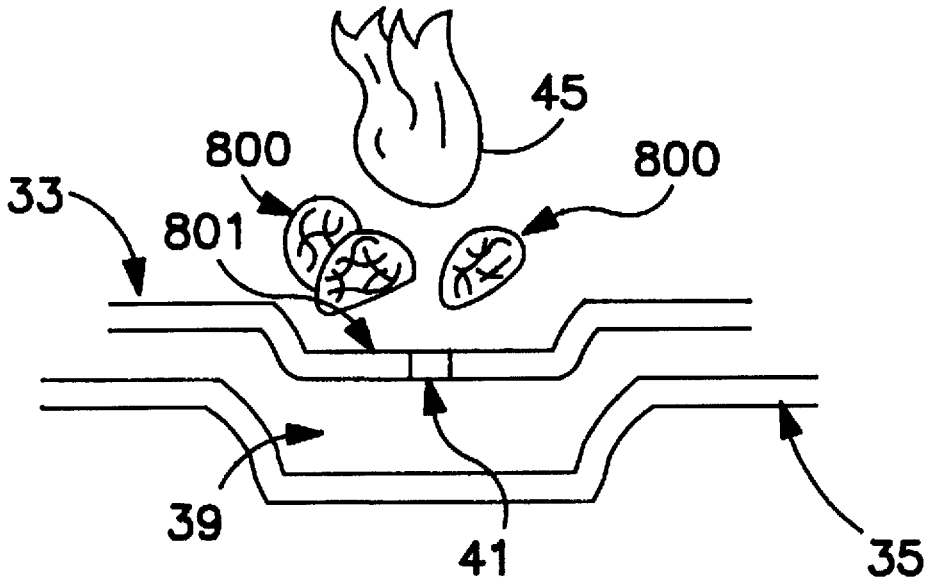

Referring to FIG. 8, simulated embers 800 may be particularly useful in obscuring from view gas ports 41 that are still visible beneath a log set 43, 103. The embers 800 could be set in a recess 801 extending into the top sheet over the channel 39 and formed in a similar manner as the depression 37. The recess 801 serves to retain the embers 800. The embers 800 should be selected or placed so as not to plug the gas ports 41. For example, a screen, not shown, may be required between the ports 41 and the embers 800. The recess 801 could follow the entire pattern of the channel 39 or there could be a series of recesses 801 for those ports 41 that are visible through the log set 43, 103

It will be understood by those skilled in the art that this description is made with reference to the preferred embodiment and that it is possible to make other embodiments employing the principles of the invention which fall within its spirit and scope as defined by the following claims.

We claim:

1. A gas burner for use in a gas fireplace with a log set which has a predetermined shape, the gas burner comprising:

a substantially flat top sheet for supporting the log set, the top sheet having a bottom surface;

a bottom sheet having a top surface abutting the bottom surface of the top sheet, the bottom sheet having a depression formed therein which, in combination with the top sheet, forms a channel for carrying combustible gas between the top and bottom sheets, the depression following a path which corresponds to the predetermined shape of the log set; and a plurality of gas ports through the top sheet into the channel and being disposed in a predetermined pattern which corresponds to the path of the depression to cause ignited gas flowing from the gas ports to impinge on the log set when the log set is disposed on the top sheet in said predetermined shape.

2. The gas burner of claim 1, further comprising: secondary air inlets through the top and bottom sheets adjacent the channel.

3. The gas burner of claim 1, wherein the top sheet comprises one or more recesses formed into the channel, the recesses for recessing at least those gas ports that would be visible through the log set, the recesses also being for receiving alternate decorative fire material for hiding the ports.

4. A burner according to claim 1, wherein said depression path comprises a figure-eight pattern.

5. A burner according to claim 1, wherein said depression path comprises a plurality of connected linear patterns.

6. A burner according to claim 1, wherein said top sheet includes at least one log locator opening for positioning the log set on the top sheet.

7. A burner according to claim 1, further comprising fastening means for connecting together the top and bottom sheets.

8. A burner according to claim 1, further comprising a pilot assembly opening in the bottom sheet in said depression.

9. A burner according to claim 1, wherein said plurality of gas ports comprises at least two sets of gas ports, each set having the plurality of ports.

10. A gas fireplace, comprising:

a firebox;

a combustion air inlet into the firebox;

an exhaust air outlet from the firebox;

a log set having a predetermined shape disposed within the firebox;

a substantially flat top sheet for supporting the log set, the top sheet being disposed in the firebox and having a bottom surface;

a bottom sheet having a top surface abutting the bottom surface of the top sheet, the bottom sheet having a depression formed therein which, in combination with the top sheet, forms a channel for carrying combustible gas between the top and bottom sheets, the depression following a path which corresponds to the predetermined shape of the log set;

at least one gas inlet port for receiving gas into the channel from a gas source outside the firebox; and a plurality of gas ports through the top sheet into the channel and being disposed in a predetermined pattern which corresponds to the path of the depression to cause ignited gas flowing from the gas ports to impinge on the log set when the log set is disposed on the top sheet in said predetermined shape.

* * * * *